United States Patent [19]

Ban

[11] Patent Number: 5,054,676

[45] Date of Patent: Oct. 8, 1991

[54] TOILET ROLL HOLDER

[75] Inventor: Kazu Ban, 13-13, 3-Chome, Yamatedai, Ibaraki-Shi, Osaka, Japan

[73] Assignees: Inax Corporation, Tokoname; Kazu Ban, Ibaraki, both of Japan

[21] Appl. No.: 536,753

[22] Filed: Jun. 12, 1990

[30] Foreign Application Priority Data

Jun. 22, 1989 [JP] Japan ..... 1-74189[U]

[51] Int. Cl.[5] ..... A47K 10/38; B65H 35/10

[52] U.S. Cl. ..... 225/42; 225/43; 225/52; 225/53; 225/75; 225/84; 225/90

[58] Field of Search ..... 225/42, 43, 51, 52, 225/53, 72, 73, 74, 82, 84, 89, 106, 75, 90; 242/55.2, 55.53

[56] References Cited

U.S. PATENT DOCUMENTS

| | | | |
|---|---|---|---|
| 444,106 | 6/1891 | Spraker | 225/32 |
| 1,159,837 | 11/1915 | Handy | 225/54 |
| 3,040,943 | 6/1962 | Bump | 225/73 |
| 3,713,569 | 1/1973 | Dashnier et al. | 225/21 |
| 4,826,063 | 2/1989 | Ban | 225/74 |

FOREIGN PATENT DOCUMENTS

| | | | |
|---|---|---|---|
| 0287545 | 10/1988 | European Pat. Off. . | |
| 0514160 | 11/1939 | United Kingdom | 242/55.5 A |
| 1538965 | 1/1979 | United Kingdom . | |

*Primary Examiner*—Mark Rosenbaum
*Assistant Examiner*—Eugenia A. Jones
*Attorney, Agent, or Firm*—Kanesaka and Takeuchi

[57] ABSTRACT

A toilet roll holder includes a frame and a cover rotatably mounted to the frame by a rotary shaft. The toilet roll holder further includes a support mounted within the cover and supporting a toilet roll thereon, an operating plate located below and adjacent to a rear edge of the support and rotatably mounted to the cover by a shaft, a brake plate rotatably mounted within the frame by a shaft extending parallel to the shaft, and converging holding frames arranged on opposite sides of the brake plate. The operating plate is inserted into the holding frames through their upper ends when the cover is moved to a closed position, and is normally fit loosely between the brake plate and the holding frames so as to permit the toilet paper to freely pass between the operating plate and the brake plate. The operating plate is moved toward an inclined position to close to the brake plate when a free end of the toilet paper is pulled forwards, whereby the operating plate and the brake plate cooperatively sandwich the toilet paper therebetween to provide a counterforce necessary to cut the toilet paper.

5 Claims, 2 Drawing Sheets

TOILET ROLL HOLDER

BACKGROUND OF THE INVENTION

1. Field of the Invention

The present invention relates to a toilet roll holder for holding a toilet roll and permitting cutting of toilet paper as unrolled.

2. Description of the Related Art

Generally, a conventional toilet roll holder does not carry means for holding toilet paper when cut. Japanese utility model application No. 62/084082, filed by the applicant of the present application, discloses a toilet roll holder suitable for cutting soft toilet paper. Paper made of a strong fiber material, such as a paper towel, is usually cut along a weakened line rather than by a cutter. In this case, the user has to hold the paper by his hands since there has not yet been proposed any braking mechanism for firmly holding the paper.

OBJECT AND SUMMARY OF THE INVENTION

It is an object of the present invention to provide a toilet roll holder wherein since the outermost end of toilet paper is sandwiched or restrained, the leading end of the toilet roll is in no way left within the toilet roll holder when the outermost end of the toilet paper is cut off, whereby the user can always hold the free end of the toilet paper in use.

It is another object of the present invention to provide a toilet roll holder wherein the free end of the toilet paper needs not pass through a narrow space between a brake plate and an operating plate and is, instead, inserted to a sufficient space between a frame and a cover as opened.

According to one aspect of the present invention, there is provided a toilet roll holder including a frame and a cover rotatably mounted to the frame by a rotary shaft, the improvement comprising a support mounted within the cover and supporting a toilet roll thereon, an operating plate located below and adjacent to a rear edge of the support and rotatably mounted to the cover by a shaft, a brake plate rotatably mounted within said frame by a shaft extending parallel to the shaft and converging holding frames arranged on opposite sides of the brake plate, said operating plate being inserted into the holding frames through their upper ends when the cover is moved to a closed position and being normally fit loosely between the brake plate and the holding frames so as to permit the toilet paper to freely pass between the operating plate and the brake plate, said operating plate being moved toward an inclined position to close to the brake plate when a free end of the toilet paper is pulled forwards whereby the operating plate and the brake plate cooperatively sandwich the toilet paper therebetween to provide a counterforce necessary to cut the toilet paper.

According to another aspect of the present invention, there is provided a toilet roll holder for holding a roll and permitting cutting of a toilet paper as unrolled therefrom, which comprises a frame including a rear portion adapted for attachment to a wall and a pair of projections extending forwardly from opposite sides of said rear portion, a cover pivotally mounted to the frame by a horizontal shaft extending between front ends of the projections, a support mounted to a rear surface of the cover to support the toilet roll thereon, a brake plate pivotally mounted to the frame by a horizontal shaft extending between lower portions of the projections, an operating plate pivotally mounted to a lower end of the cover by a horizontal shaft and locatable in a confronting relation to the brake plate, and a holder provided at opposite sides of the brake plate for holding opposite sides of the operating plate, whereby when the toilet paper passing between the brake plate and the operating plate is pulled, the operating plate and the brake plate are both moved toward an inclined position through the holder with their lower ends moved forwards, so that the lower ends of the operating plate and the brake plate cooperate to tightly sandwich the toilet paper therebetween.

DESCRIPTION OF THE PREFERRED EMBODIMENT

Figure 1:
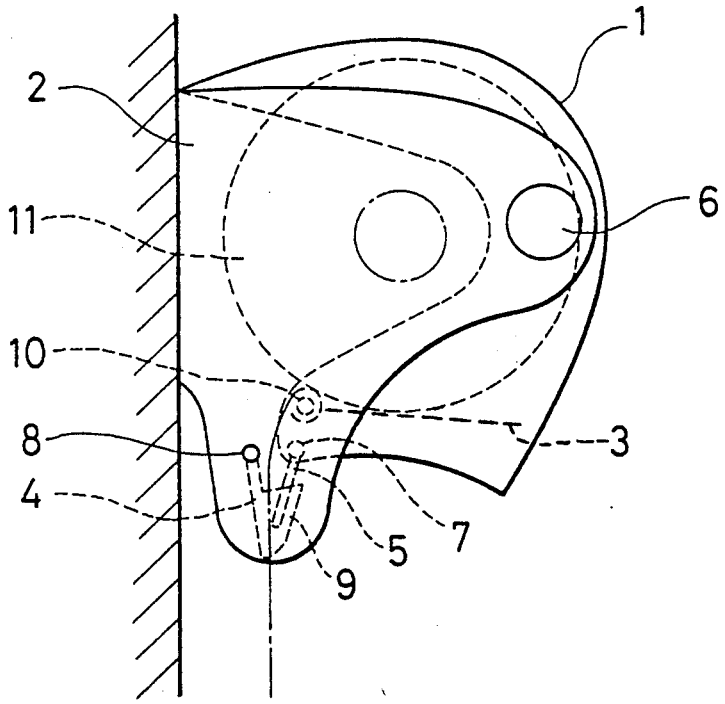
FIG. 1 is a side view of a toilet roll holder according to the present invention.
Figure 2:
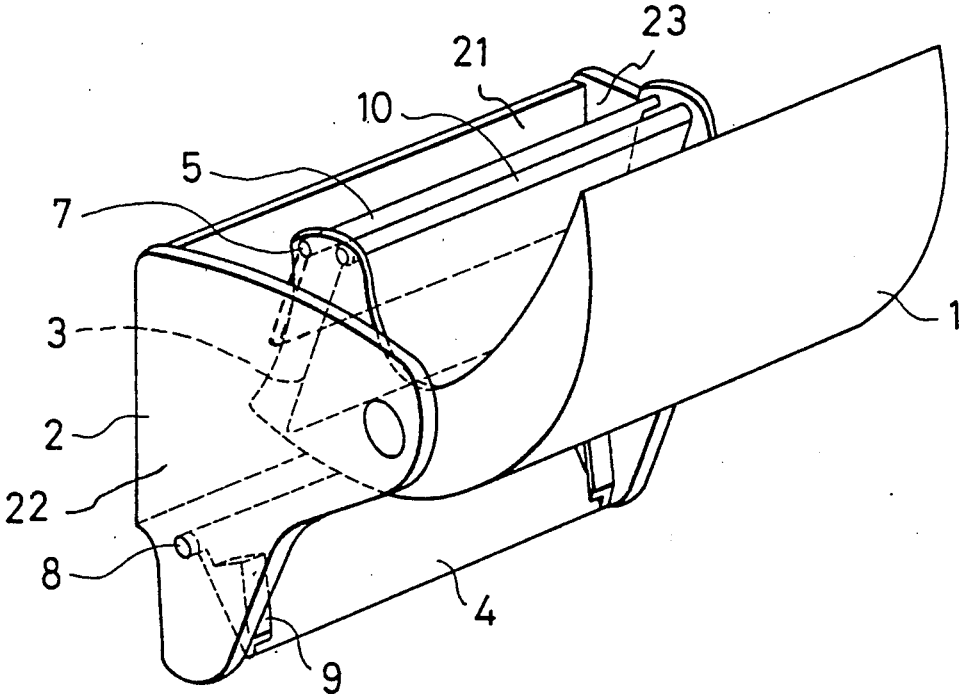
FIG. 2 is a perspective view of the toilet roll holder with a cover moved to an open position.
Figure 3:
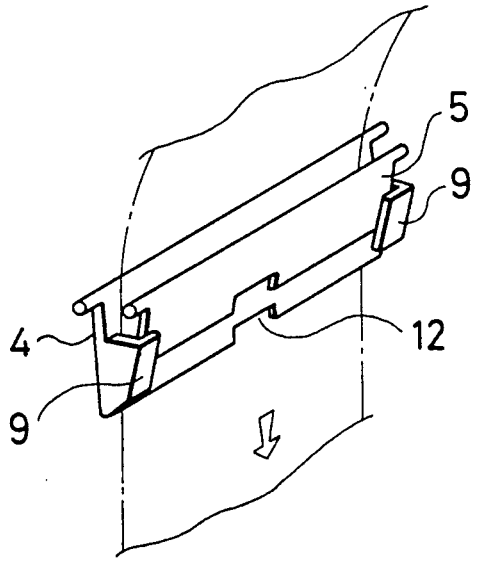
FIGS. 3 and 4 are views showing the manner in which toilet paper is sandwiched between an operating plate and a brake plate.
Figure 4:
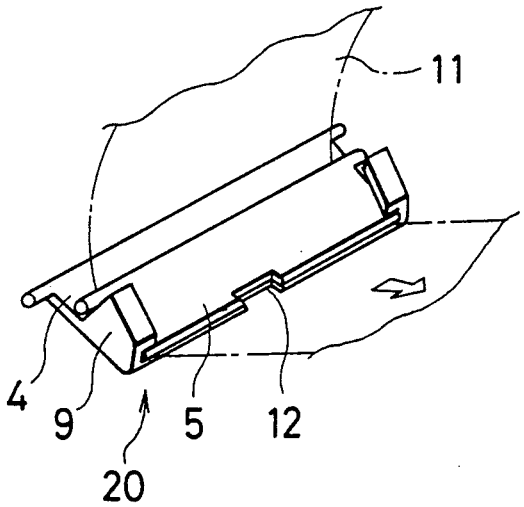
Figure 5:
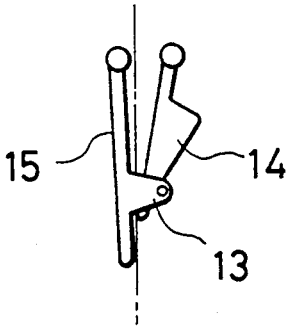
FIGS. 5 and 6 are side views of an operating plate with projections and a brake plate with which the operating plate is engaged.
Figure 6:
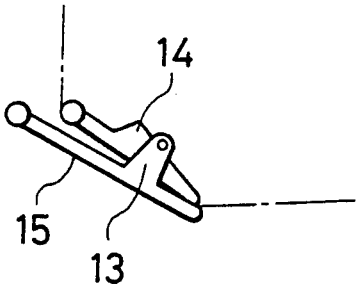

With reference to FIGS. 1 and 2, a toilet roll holder includes a frame 2 which has a rear portion 21 for attachment to a wall and a pair of projections 22, 23 extending forwardly from opposite sides of the rear portion 21. A cover 1 is rotatably mounted to the frame 2 by a rotary shaft 6. The frame 2 and the cover 1 cooperate to contain a toilet roll 11. A brake plate 4 depends from the frame 2 and is rotatable about a shaft 8 as will be hereinafter described. The cover 1 includes a support 3 having a surface on which the toilet paper 11 is slidably mounted. A roller 10 is mounted to the rear edge of the support 3 so as to reduce the friction between the support 3 and the toilet paper 11. An operating plate 5 is pivotally mounted to the cover 1 by a rotary shaft 7 and is located below and adjacent to the roller 10. The operating plate 5 is spaced from the brake plate 4 to have confronting relation thereto. With this arrangement, the horizontal shafts 7 and 8 extend parallel and are spaced from each other by, for example, 4 to 10 mm. The brake plate 4 has integral holding frames 9 at its opposite ends so as to hold both sides of the operating plate 5. With the operating plate 5 restrained by the holding frames 9, a space is defined between the brake plate 4 and the operating plate 5 and is V-shaped as viewed in side elevation in FIG. 1. Under the circumstances, the toilet paper 11 is loosely held between the operating plate 5 and the brake plate 4. If the operating plate 5 is moved toward an inclined position with its front end moved forwards, then a contact point between the operating plate 5 and the brake plate 4 is gradually reduced. Further movement of the operating plate 5 reduces a space defined between the operating plate 5 and the brake plate 4, and the operating plate 5 is finally pressed against the brake plate 4. It will be appreciated that the operating plate 5 is restrained relative to the brake plate 4 and the holding frames 9. Although the holding frames 9 define V-shaped spaces in the illustrated embodiment, an operating plate 14 may have a pair of V-shaped projections at its opposite ends as shown in FIGS. 5 and 6. In such a case, a brake plate 15 has a pair of holding frames 13 so as to provide a fixed space within which the operating plate 14 is restrained.

In order to cut the toilet paper, the toilet roll must be stopped, and required tension is then applied to the toilet paper. Such tension occurs between a force by which the user pulls the leading end of the toilet paper and a braking force applied to the remaining toilet roll. Such a braking force is thus essential for cutting the toilet paper. According to the invention, the toilet paper passes between the operating plate 5 depending from the shaft 7 and the brake plate 4 depending from the shaft 8. When the toilet paper is pulled downwardly the holding frames 9 do not restraint the operating plate 5, and a space between the plates 5 and 4 is large enough to permit free passing of the toilet paper as stated above.

In cutting the paper, the paper is pulled so that the operating plate 5 is moved from a vertical position to an inclined position. This causes the brake plate 4 to also move toward an inclined position though the holding frames 9. As a result, the free or lower end of the operating plate 5 is moved toward the free or lower end of the brake plate 4 while the both plates 4 and 5 are being in contact with each other. This movement of the operating plate 5 gradually reduces the space defined between the operating plate 5 and the brake plate 4. The paper is then pressed between the operating plate 5 and the brake plate 4, and a braking force is applied thereto. If the paper is further pulled, then the paper is cut, for example, along a weakened line. Under the circumstances, paper extending from the remaining toilet rolls is free of tension, and the operating plate 5 is returned to its original or vertical position to sandwich the paper with the brake plate 4. It will be appreciated that when a paper has weakened line therein, the paper may be cut at such a weakened line outside the toilet roll holder. If a cutter (not shown) may be attached to an appropriate portion of the toilet roll holder, the paper can be easily cut under such tension without a weakened line.

With the toilet roll holder thus constructed, since the outermost end of the toilet paper is sandwiched or restrained, the leading end of the remaining toilet roll is in no way left within the toilet roll holder. The user can always hold the leading end of the toilet paper in use.

The brake plate 4 may have a recess 12 centrally at its free end, and also the operating plates may have a recess corresponding to the recess 12, so as to provide a space for receiving paper by the user's fingers. The upper end of the operating plate 5 may extend sufficiently above the shaft 7. When the operating plate 5 is moved toward an inclined position to provide a braking force, the toilet paper as unrolled extends rearwardly of the shaft 7 by a length corresponding to the length of the paper extending above the shaft 7. In this way, when the operating plate 5 is returned to its vertical position, the toilet paper depends from the lower end of the operating plate 5 by a length corresponding to the length of the paper which extends rearwardly of the shaft 7.

As is clear from FIG. 2, when the cover 1 is rotated about the rotary shaft 6 to move to its open position, the operating plate 5 is moved away from or disengaged from the brake plate 4. A toilet roll is then placed within the cover 1. In this way, the free end of the toilet paper need not pass through a narrow space defined between the brake plate 4 and the operating plate 5. In other words, the free end of the toilet paper can be easily inserted to a large space between the cover 1 and the frame 2 upon loading.

Although the preferred embodiments of the present invention have been described, it will be understood to one skilled in the art that various changes and modifications may be made therein without departing from the spirit of the invention and the scope of the appended claims.

What is claimed is:

1. A toilet roll holder for holding a toilet roll and permitting cutting of toilet paper unrolled therefrom, comprising:

a frame adapted to be attached to a wall and having a pair of projections, a cover pivotally mounted between the projections of the frame and having a rear portion and a lower portion, said cover being movable between an open position and a using position, a support attached to the rear portion of the cover so that the support rotationally supports the toilet roll thereon at the using position of the cover, a brake plate pivotally mounted between the projections of the frame, said brake plate being located below the toilet roll, an operating plate pivotally mounted on the lower portion of the cover, said operating plate, at the using position, being located under the support and situated at least adjacent to the brake plate and said operating plate, at the open position, being located above and away from the brake plate, and holding means attached to the brake plate for slidably holding the operating plate relative to the brake plate so that at the using position, when toilet paper passing between the brake plate and the operating plate is pulled downwardly, the toilet paper is withdrawn without restriction, and when the toilet paper is pulled forwardly to incline the brake plate and the operating plate, the brake plate and the operating plate cooperate together to hold the toilet paper at forward ends thereof.

2. A toilet roll holder according to claim 1, wherein said projections of the frame include front portions, said cover being pivotally mounted at the front portions of the projections so that the cover can be turned between the opening position and the using position without allowing the support to face downwardly.

3. A toilet roll holder according to claim 1, wherein said holding means are holding frames formed at the brake plate, each holding frame forming a V-shape space together with the brake plate pointing downwardly, said operating plate being situated in the V-shape space in the using position.

4. A toilet roll holder according to claim 1, wherein said holding means are holding frames formed at the brake plate, each holding frame forming a fixed space together with the brake plate, said operating plate having a pair of V-shape projections pointing downwardly, said V-shape projections being situated in the fixed spaces at the using position.

5. A toilet roller holder according to claim 1, wherein said brake plate and said operating plate have recesses at lower portions thereof to facilitate receiving of toilet paper between the brake plate and the operating plate at the using position.

* * * * *